US012122569B2

(12) United States Patent
Forenza

(10) Patent No.: US 12,122,569 B2
(45) Date of Patent: Oct. 22, 2024

(54) CHILD RESISTANT LOCKABLE CONTAINER

(71) Applicant: Jam Packaging LLC, Miami Gardens, FL (US)

(72) Inventor: Michael Forenza, Miami Gardens, FL (US)

(73) Assignee: JAM PACKAGING LLC, Miami Gardens, FL (US)

( * ) Notice: Subject to any disclaimer, the term of this patent is extended or adjusted under 35 U.S.C. 154(b) by 58 days.

(21) Appl. No.: 18/187,252

(22) Filed: Mar. 21, 2023

(65) Prior Publication Data

US 2023/0234760 A1 Jul. 27, 2023

Related U.S. Application Data

(63) Continuation-in-part of application No. 17/525,528, filed on Nov. 12, 2021, now Pat. No. 11,840,381, which is a continuation-in-part of application No. 16/940,643, filed on Jul. 28, 2020, now Pat. No. 11,174,082, which is a continuation-in-part of application No. 16/598,021, filed on Oct. 10, 2019, now Pat. No. 10,954,028.

(51) Int. Cl.
*B65D 50/04* (2006.01)
*B65D 5/38* (2006.01)

(52) U.S. Cl.
CPC ..... *B65D 50/045* (2013.01); *B65D 5/38* (2013.01); *B65D 2215/02* (2013.01)

(58) Field of Classification Search
CPC .... B65D 50/045; B65D 5/38; B65D 2215/02; B65D 5/5007; B65D 11/12
USPC ..... 206/1.5, 468, 528, 531, 536, 557, 560, 206/565; 229/125.125
See application file for complete search history.

(56) References Cited

U.S. PATENT DOCUMENTS

| | | | | |
|---|---|---|---|---|
| 4,007,828 | A * | 2/1977 | Mayled | B65D 11/12 220/8 |
| 4,561,544 | A * | 12/1985 | Reeve | B65D 50/045 220/345.3 |
| 8,091,709 | B2 * | 1/2012 | Gnepper | B65D 11/12 206/536 |
| 8,453,840 | B2 * | 6/2013 | Wharton | B65D 11/12 206/468 |
| 11,046,476 | B2 * | 6/2021 | Whitehurst | B65D 79/00 |
| 2009/0152134 | A1 * | 6/2009 | Katsis | B65D 5/38 206/96 |
| 2011/0036743 | A1 * | 2/2011 | Wharton | B65D 5/38 206/531 |

* cited by examiner

*Primary Examiner* — Luan K Bui
(74) *Attorney, Agent, or Firm* — Lott & Fischer, PL

(57) ABSTRACT

A lockable container comprising a sleeve having at least three sidewalls defining a pocket, the pocket having at least one entrance, and the pocket adapted for receiving and housing a resilient tray, a least one sidewall of the sleeve having a hole; a resilient tray having three sidewalls, a partial sidewall, a floor and a button, the button located contiguous to the partial sidewall, and hinged to the floor by a cantilevered tab, the resilient tray comprised of a flexible, semi-rigid material; wherein the button is substantially aligned with the hole when the resilient tray is housed within the sleeve, causing the button to protrude through the hole; and wherein the resilient tray is prevented from sliding out of the sleeve unless the button is pressed to disengage the hole.

1 Claim, 27 Drawing Sheets

CHILD RESISTANT LOCKABLE CONTAINER

CLAIM OF PRIORITY

This application is a continuation-in-part of U.S. patent application Ser. No. 17/525,528, filed on Nov. 12, 2021, which is a continuation-in-part of U.S. patent application Ser. No. 16/940,643, filed on Jul. 28, 2020, now U.S. Pat. No. 11,174,082, which is a continuation-in-part of U.S. patent application Ser. No. 16/598,021, filed on Oct. 10, 2019, now U.S. Pat. No. 10,954,028, all of which are incorporated herein by reference.

FIELD OF INVENTION

The present invention relates to a container. More specifically, the container may be locked and unlocked by the depression of a button.

BACKGROUND

Many items contained in a person's household may pose dangers due to accidental encounters with those items by persons or animals not intended to have access to such items. The owners of these items often wish to secure the items in a manner whereby unauthorized or unintended users cannot access them. One way to limit access to such persons or animals is to make it difficult for one to accidently or unintentionally open containers containing items that may pose a risk, often accomplished by the use of a type of locking mechanism. Therefore, there exist containers that require specific manipulation to retrieve the contents within the container. Types of these containers include medicine bottles that require a cap to be depressed and rotated to a certain degree, as well as food containers that may feature certain latches or locks.

These containers can often be overcomplicated and difficult for even an ordinary person to quickly access the contents within the container. Further, the manufacturing costs of the containers may be quite high due to the complexity of the locking mechanism and material used for the container. The current state of the art further lacks a simple configuration for a small lockable container in the shape of a box or rectangular prism.

Therefore, there is a need in the art for a container that is easily opened by an adult, but resistant to accidental or unintentional opening by a child or pet. There is a further need in the art for a configuration of a lockable rectangular prism that is cheap to manufacture and simple to use.

BRIEF SUMMARY OF INVENTION

It is among the objects of this disclosure to overcome the limitations and defects of the heretofore-known devices by providing inventive features to achieve a lockable container that can be easily manipulated between a closed and opened position. The disclosure provides a lockable container comprising a tray and a first sleeve. In a locked position, the tray is completely housed within a pocket of the first sleeve. In an unlocked position, the tray may exit the pocket through an entrance, defined by an entrance rim. The dimensions of the pocket of the first sleeve are significantly similar to that of the tray element. The tray may have at least one wall and a base that define an open area within. At least one wall further contains a hole therethrough. A sidewall of the first sleeve that corresponds to the wall of the tray when the tray is housed within the first sleeve also contains a hole therethrough. The location of the hole of the first sleeve is aligned with the hole of the tray when the tray is in the locked position.

The container further comprises a foam insert and a button. The foam insert may be situated in the open area of the tray and proximate the hole of the tray element. The button is located between the foam insert and the tray and extends distally through the hole of the tray element. In the locked position, the button also extends distally through the hole of the first sleeve, whereby the tray is secured in the pocket of the first sleeve because of the contact between the button and the edges of the hole of the first sleeve.

The button and foam insert are designed so that the button may be depressed against the foam insert. When the button is depressed to a distance lower than that of the sidewall of the first sleeve, the tray is no longer locked to the first sleeve. The first sleeve may further comprise an opening at the end opposite of the entrance to the pocket, allowing a user of the container to push the tray out through the entrance once the button has been depressed and the tray has been unlocked.

The first sleeve may further contain a stopping mechanism adapted for obstructing the complete removal of the tray from the pocket of the first sleeve. In one embodiment, the first sleeve may further comprise a tab located at an edge of the entrance rim and folded inwardly into the pocket. The tab is located on the edge of the entrance rim corresponding with the wall of the tray where the button is located. Thereby, when the tray is sliding out of the pocket of the first sleeve, the button will contact the tab prior to the complete removal of the tray element. The tab will hinder the passage of the button unless an excess amount of force is used to cause the tab to fold in on itself.

In one embodiment, multiple buttons are employed in the manner above and manipulated simultaneously to unlock the tray element. In another embodiment, multiple holes may be featured at different locations and different sidewalls of the first sleeve so that the tray may be inserted into the pocket in any possible orientation and the button will still engage at least one hole.

In an alternative embodiment, the tray is replaced by a secondary first sleeve adapted to be completely housed within the first sleeve. The secondary first sleeve may comprise an open area, with at least one wall substantially surrounding the open area. The open area of the secondary first sleeve may be accessed via a door or opening flap in the at least one wall. The at least one wall of the secondary first sleeve further contains a hole therethrough. The location of the hole of the secondary first sleeve corresponds to location of the hole of the first sleeve, whereby the hole of the first sleeve and the hole of the secondary first sleeve overlap when the secondary first sleeve is fully housed within the first sleeve. A receptacle may be disposed within the open are of the secondary first sleeve, adapted to receive and temporarily secure an object. A button and a spring may also be disposed within the open area of the secondary first sleeve, whereby the button extends outwardly through the holes of the secondary first sleeve and the first sleeve in a locked position. The spring may be situated in the open area proximate the button and opposite the hole of the first sleeve, whereby the spring opposes the force caused by a depression of the button during the unlocking of the container. The first sleeve and secondary first sleeve may also comprise an opening or window on corresponding walls whereby the object secured within the receptacle may be viewed from outside the first sleeve in the locked position.

DETAILED DESCRIPTION OF THE INVENTION

Implementations of the invention provide a container adapted to secure an object within using a locking mechanism that may be quickly manipulated from a locked position to an unlocked position and vice versa.

Figure 1:
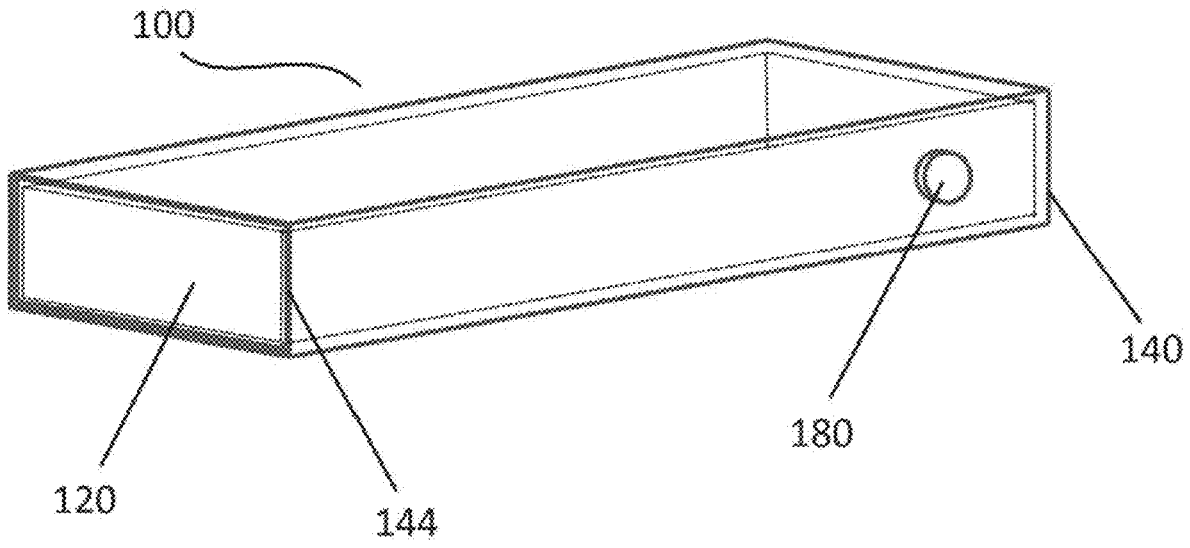
FIG. 1 is a perspective view of the apparatus in a locked position in accordance with one embodiment of the present disclosure.

The lockable container 100 of the present disclosure is shown in the accompanying drawings. As shown in FIG. 1, the container 100 generally comprises a tray 120 and a first sleeve 140. The tray 120 is adapted to be housed within a pocket of the first sleeve 140. The dimensions of the tray 120, such as its height, width, and length, substantially correspond to the inner dimensions of the pocket of the first sleeve 140, whereby the tray 120 may be completely housed within the first sleeve 140. The first sleeve 140 further comprises an entrance, defined by an entrance rim 144. The tray 120 may enter the first sleeve 140 through the entrance of the first sleeve 140. Although depicted in the figures as a rectangular prism, the container 100 may have any configuration, such as a cylinder, box, elliptical tube, or any other configuration known in the art.

Figure 2:
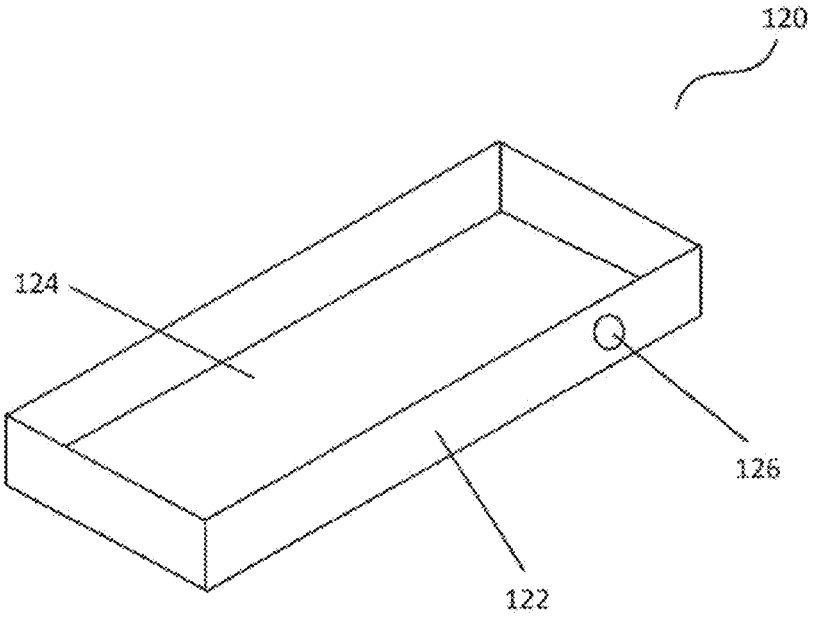
FIG. 2 is a perspective view of the tray of the apparatus in accordance with one embodiment of the present disclosure.

As shown in FIG. 2, the tray 120 may comprise at least one wall 122 and a base 124. The wall 122 and base 124 define an open area. In one embodiment of the container 100, the tray 120 comprises four walls 122 extending upward from the edge of the base 124 of the tray 120. The tray 120 further comprises a hole 126 through the wall 122 or base 124. The hole 126 may be through any face that is not opposite the entrance of the pocket of the first sleeve 140 when the tray 120 is disposed within the first sleeve 140. The hole 126, as shown, may be circular in shape. However, the hole 126 may be configured in any shape whatsoever, such as square, rectangular, or crescent. The position of the hole 126, as shown, may be proximate an end opposite the entrance of the pocket of the first sleeve 140 when the tray 120 is housed within the first sleeve 140; however, the hole 126 may be located at any position on the wall 122, including the center of the length of the wall 122 or proximate the entrance of the pocket of the first sleeve 140.

Figure 3A:
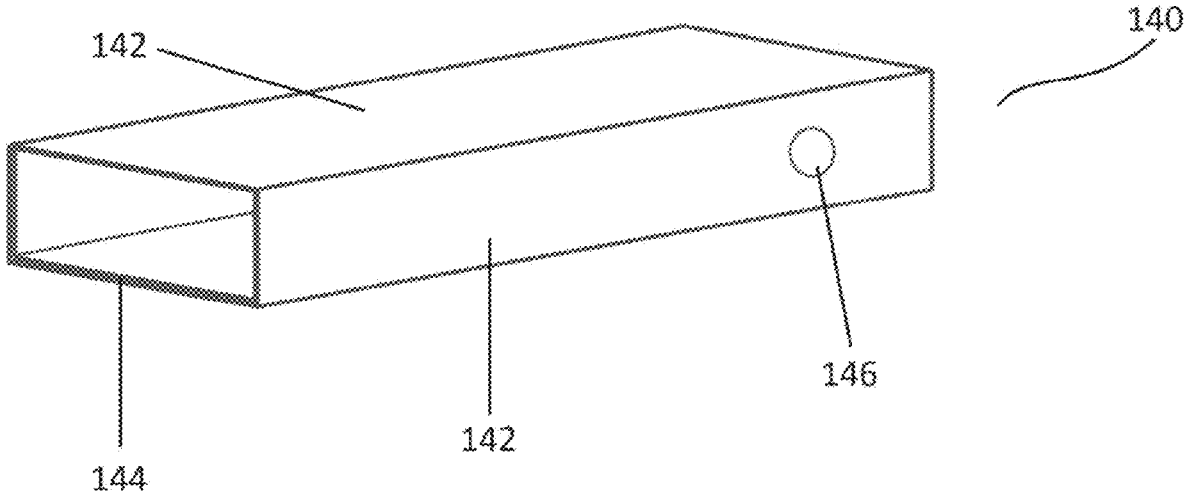
FIGS. 3A and 3B are top and bottom perspective views of the first sleeve of the apparatus in accordance with one embodiment of the present disclosure.
Figure 3B:
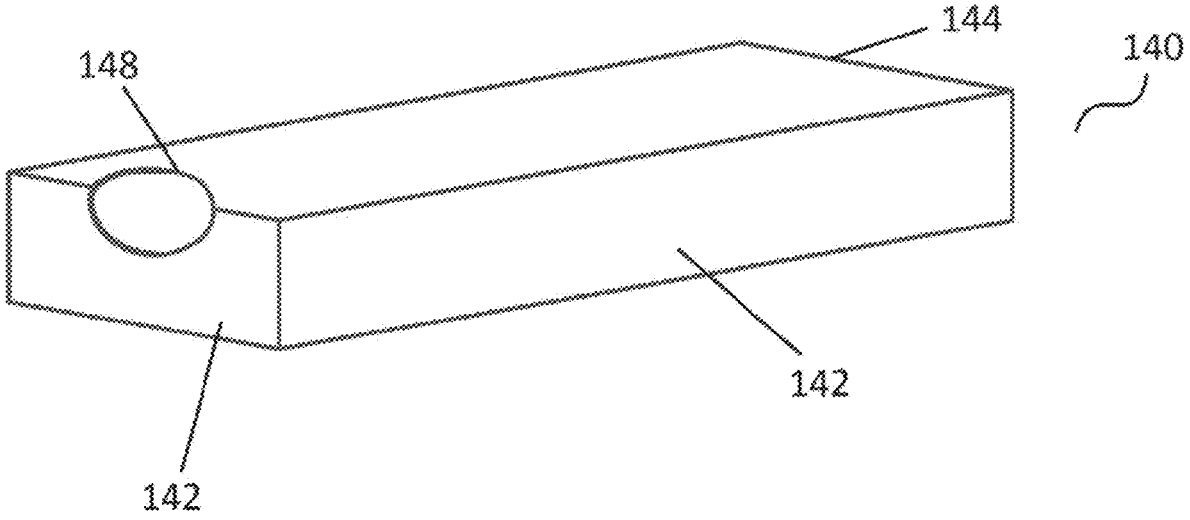

As shown in FIGS. 3A and 3B, the first sleeve 140 may comprise of one or more sidewalls 142. In one embodiment, the first sleeve 140 comprises five sidewalls 142 defining the pocket of the first sleeve 140. As shown in FIG. 3A, the entrance to the pocket, defined by the entrance rim 144, is located on a side of the first sleeve 140 corresponding to a smallest face of the container 100. However, the entrance of the pocket of the first sleeve 140 may be located on any face of the container regardless of the area of that face.

The first sleeve 140 is further comprised of a hole 146 through at least one sidewall 142. The position of the hole 146 of the first sleeve 140 corresponds with the position of the hole 126 of the tray 120, when the tray 120 is housed within the first sleeve 140. Further, the size and shape of the hole 146 of the first sleeve 140 also corresponds to the size and shape of the hole 126 of the tray 120. Thus, when the tray 120 is fully housed within the first sleeve 140, the hole 126 of the tray 120 and the hole 146 of the first sleeve 140 are substantially aligned so that an opening exists from the open area of the tray 120 to outside the first sleeve 140.

In one embodiment of the disclosure the first sleeve 140 may also be comprised of an opening on one or more sidewalls 142. The opening may be defined by an opening edge 148. The opening is adapted for assisting a user of the container to either push or pull the tray 120 out of the pocket of the first sleeve 140. In one embodiment, as demonstrated in FIG. 3B, the opening is at an edge between two sidewalls 142 on an end of the first sleeve 140 opposite the entrance to the pocket. Thereby, a user may use push the tray 120 via the opening at least partially out of the pocket of the first sleeve 140. Subsequently, the user may grab the partially removed tray 120 and pull to further remove the tray 120. Alternatively, the opening may be featured on opposite sidewalls 142 proximate to the entrance of the pocket of the first sleeve 140, whereby the user may grab tray 120 via the opening and pull the tray 120 at least partially out of the first sleeve 140.

Figure 4:
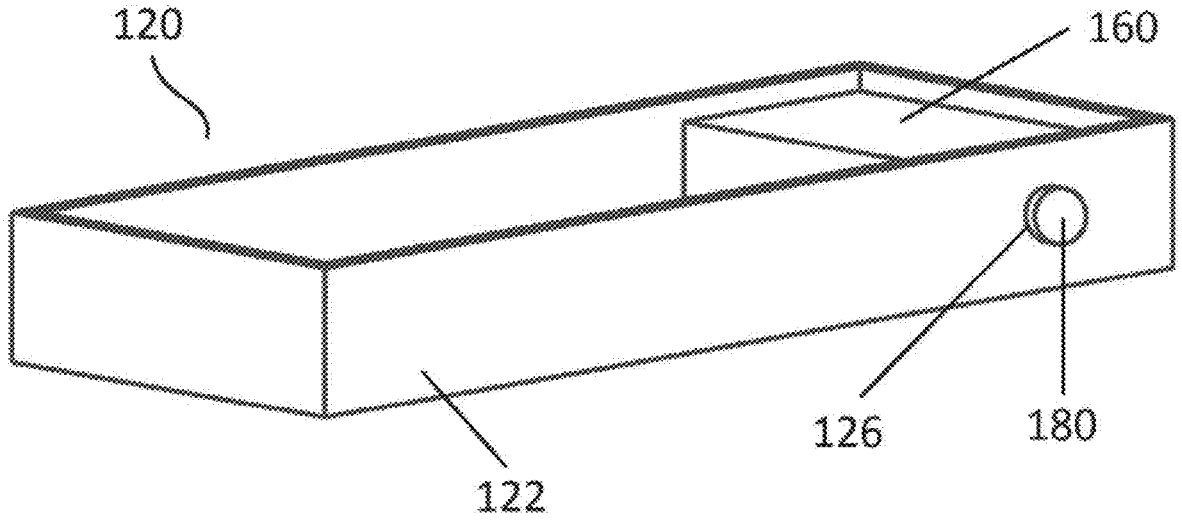
FIG. 4 is a perspective view of the tray with the foam insert and button in accordance with one embodiment of the present disclosure.

As shown in FIG. 4, the container further comprises a foam insert 160. The foam insert 160 is situated within the open area of tray 120. The foam insert 160 may be located proximate the hole 126 of the tray 120. The height of the foam insert 160 may be at least that of the top of the hole 126 of the tray 120. The width of the foam insert 160 may be substantially equal to the base 124 of the tray 120, wherein a side of the foam insert 160 that is opposite a side proximate to the hole 126 of the first sleeve 120 is against a wall 122 of the tray 120 or is against a sidewall 142 of the first sleeve 140 when the tray 120 is housed within the first sleeve 140. The length of the foam insert 160 may extend the length of the open area or it may have a length that is slightly larger than the width of the hole 126, as demonstrated in FIG. 4. The foam insert 160 may be adhesively attached to the base 124 or wall 122 of the tray 120. Alternatively, the foam insert 160 may be secured in the open area by opposing forces of opposing walls 122 of the tray 120 compressing the foam insert 160.

Figure 5A:
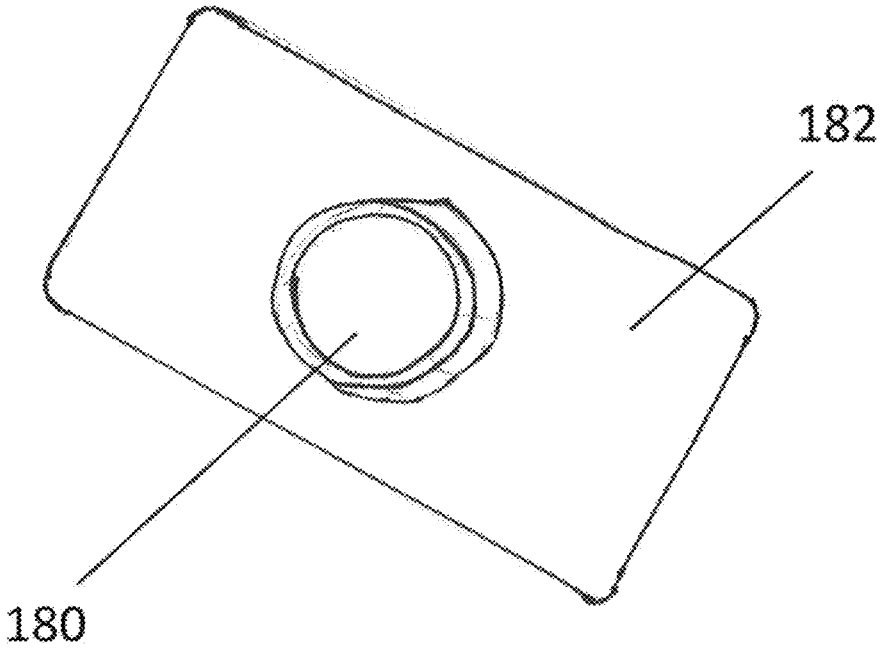
FIG. 5A is a perspective view of the button in accordance with one embodiment of the present disclosure.
Figure 5B:
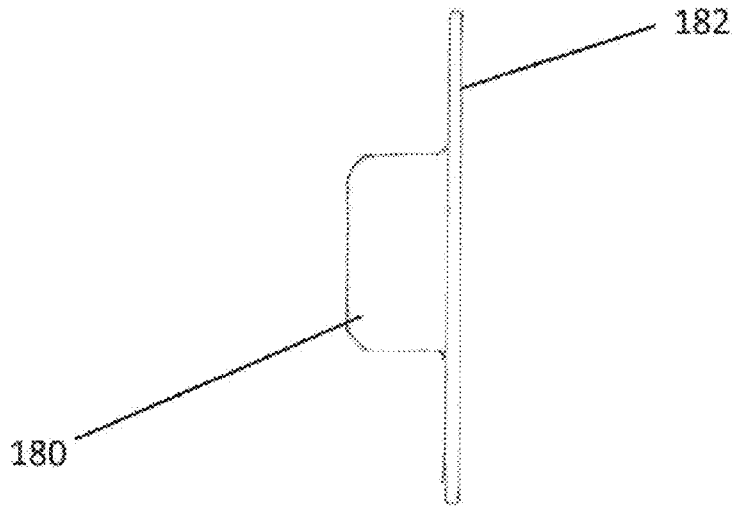
FIG. 5B is a side view of the button in accordance with one embodiment of the present disclosure.

The container 100 is further comprised of a button 180. The button 180 is disposed between the foam insert 160 and the wall 122 of the tray 120. Referring to FIGS. 5A and 5B, the button 180 may comprise a button base 182 from which the button 180 extends. The button 180 extends distally out of the hole 126 of the tray 120, as demonstrated in FIG. 4. The shape of the button 180 may correspond with the shape and size of the hole 126 of the tray 120. However, the button 180 may be smaller than the size of the hole 126 of the first sleeve 120, whereby additional clearance is allowed between the button 180 and edges of the hole 126 of the tray 120. The button base 182 may be a substantially flat surface surrounding a bottom edge of the outwardly extending button 180. The button base 182 may lay flat against an inner face of the wall 122 of tray 120 so that the button 180 is secured between the tray 120 and the foam insert 160.

In one embodiment, the button 180 and button base 182 may be held in place via compression by the wall 122 of the tray 120 and the foam insert 160. In another embodiment, the button may be adhesively attached to a side of the foam insert 160. In yet another embodiment, the button 180 and the foam 160 are manufactured as a unitary piece, with the button 180 extending distally from an outer face of the foam 160.

When the container 100 is in a locked position, as shown in FIG. 1, the button 180 extends distally from the open area of the tray 120 through both the hole 126 of the tray 120 and the hole 146 of the first sleeve 126. Thereby, the tray 120 is secured within the first sleeve 140 because any potential movement of the tray 120 is hindered by a side of the button 180 pressing against an edge of the hole 146 of the first sleeve 140.

The tray 120 may be partially removed from the first sleeve 140, by the depression of the button 180 upon the foam 160. When the button 180 is depressed inwardly to a position whereby the button 180 does not extend substantially into the hole 146 of the first sleeve 140, the tray 120 may partially pulled or pushed out of the first sleeve 140. A distal end of the button 180 may be tapered, whereby if the tapered end of the button 180 engages the edge of the hole 146 of the first first sleeve, the force of the tapered end of the button 180 upon the edge of the hole 146 will cause the button to move beneath the edge and out of the hole 146, allowing for release of the tray 120.

As the tray 120 is removed from the pocket of the first sleeve 140, the button 180 slides against an inner face of the sidewall 142 of the first sleeve 140. In one embodiment, the tray 120 may be completely removed from the first sleeve 140 once the button 180 passes out of the entrance to the pocket of the first sleeve 140. To reinsert the tray 120 into the first sleeve 140, the button 180 must be depressed such that the tray 120 and the outwardly extending button 180 may fit within the pocket of the first sleeve 140. Once the tray is fully returned to a closed position, whereby the hole 126 of the tray 120 align with the hole 146 of the first sleeve 140, the resilient nature of the foam insert 160 will push the button 180 once again through the hole 146 of the first sleeve 140. In one embodiment of the disclosure, the location of the button 180 and the location of the opening of the first sleeve are coordinated in a manner that a user may depress the button 180 and simultaneously push out the tray 120 with a single hand.

Figure 6:
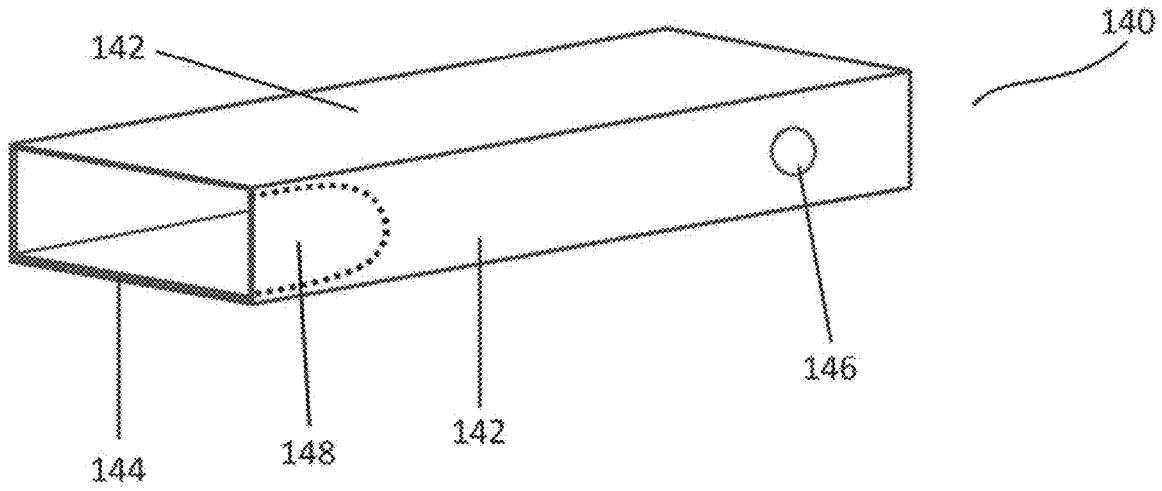
FIG. 6 is a perspective view of the apparatus detailing the locking mechanism in accordance with one embodiment of the present disclosure.

In another embodiment of the container 100, a stopping mechanism is located on an inner face of the sidewall 142 of the first sleeve 140. The stopping mechanism is adapted to engage the button 180, thereby hindering complete removal of the tray 120 from the pocket of the first sleeve 140. As shown in FIG. 6, the stopping mechanism may be an inwardly folded tab 148 attached at the entrance rim 144 of the first sleeve 140. The tab 148 is located on the edge of the entrance rim 144 that corresponds to the sidewall 142 featuring the hole 146 of the first sleeve 140. Thereby, when the button 180 is depressed and the tray 120 is being removed from the pocket of the first sleeve 140, a side face of the button 180 will contact the tab 148. As a majority of the tray 120 is outside of the first sleeve 140, any object intended to be secured within the open area of the tray 120 may be accessed or removed. However, the tray 120 cannot be fully removed due to the obstruction of the button 180 caused by the contact with the tab 148, unless excessive force is used, causing the tab 148 to fold in on itself. Although disclosed in one embodiment as an inwardly folded tab 148, the stopping mechanism may take other forms. These include, but are not limited to, a protrusion featured on the inner face of the sidewall 142 of the first sleeve 140 adapted to obstruct the button 180 or a recess on the inner face of the sidewall 142 of the first sleeve 140 adapted to allow the button to expand into the recess and hinder the button 180 from sliding out of the pocket.

In another embodiment of the disclosure, the first sleeve 140 comprise a secondary hole (not shown), similar in size and shape to hole 146, on the same face of the sidewall 142 where the hole 146 of the first sleeve 140 is located. The secondary hole may be located more proximal to the entrance rim 144 than the hole 146, towards the end of the first sleeve 140 comprising the entrance to the pocket and in line with a path the button 180 travels along the inner face of the sidewall 142. The secondary hole is shaped and placed so that the button 180 will expand into the secondary hole upon reaching its location. This would effectively lock the tray 120 in the open position, until the button is again depressed and the tray 120 is either pulled further out from the first sleeve, or pushed further into the first sleeve 140 and optionally returned to the closed position.

In one embodiment of the disclosure, the first sleeve 140 may be manufactured a single flat piece and subsequently folded and glued to create the structure of the first sleeve 140. In this embodiment, the first sleeve 140 may feature inwardly folded tabs on each edge of the entrance rim 144. All tabs may be glued down to the inner face of the sidewalls 142 of the first sleeve 140. However, the tab on the edge corresponding to the sidewall 142 featuring the hole 146 may be left unglued, whereby the unglued tab will act as the stopping mechanism hindering complete removal of the tray 120 from the pocket of the first sleeve 140.

This disclosure should not be limited to the use of one button 180 for the locking and unlocking of the container 100. The container 100 may comprise two or more buttons 180 located between the foam insert 160 and the tray 120 and extend distally through two or more holes 126 of the tray 120 and two or more holes 146 of the first sleeve. Thereby, a user must simultaneously depress the two or more buttons 180 in order to partially remove the tray 120, in accordance with the disclosure above. The two or more buttons 180 may be located laterally to one another, above and below one another, or on opposite or adjacent faces. Further, it is within the scope of this disclosure that while the container may only feature one button 180, the first sleeve 140 feature multiple holes on differing locations and faces of the sidewalls 142, wherein the tray 120 may enter the pocket of the first sleeve 140 in differing orientations and the button 180 will engage at least one hole 146.

In an alternate embodiment, disclosed in FIGS. 7-14, the tray 120 is replaced by a second sleeve 220. In a similar arrangement to the embodiment disclosed above, when the container 200 is in a fully closed position, the second sleeve 220 is completely disposed within a pocket of the first sleeve 240. This embodiment also comprises a button 280, a spring 260, and a receptacle 250, adapted for receiving and securing an object 290. In this embodiment, the receptacle 250, the button 280, and the spring 260 are situated within the second sleeve 220.

Figure 8:
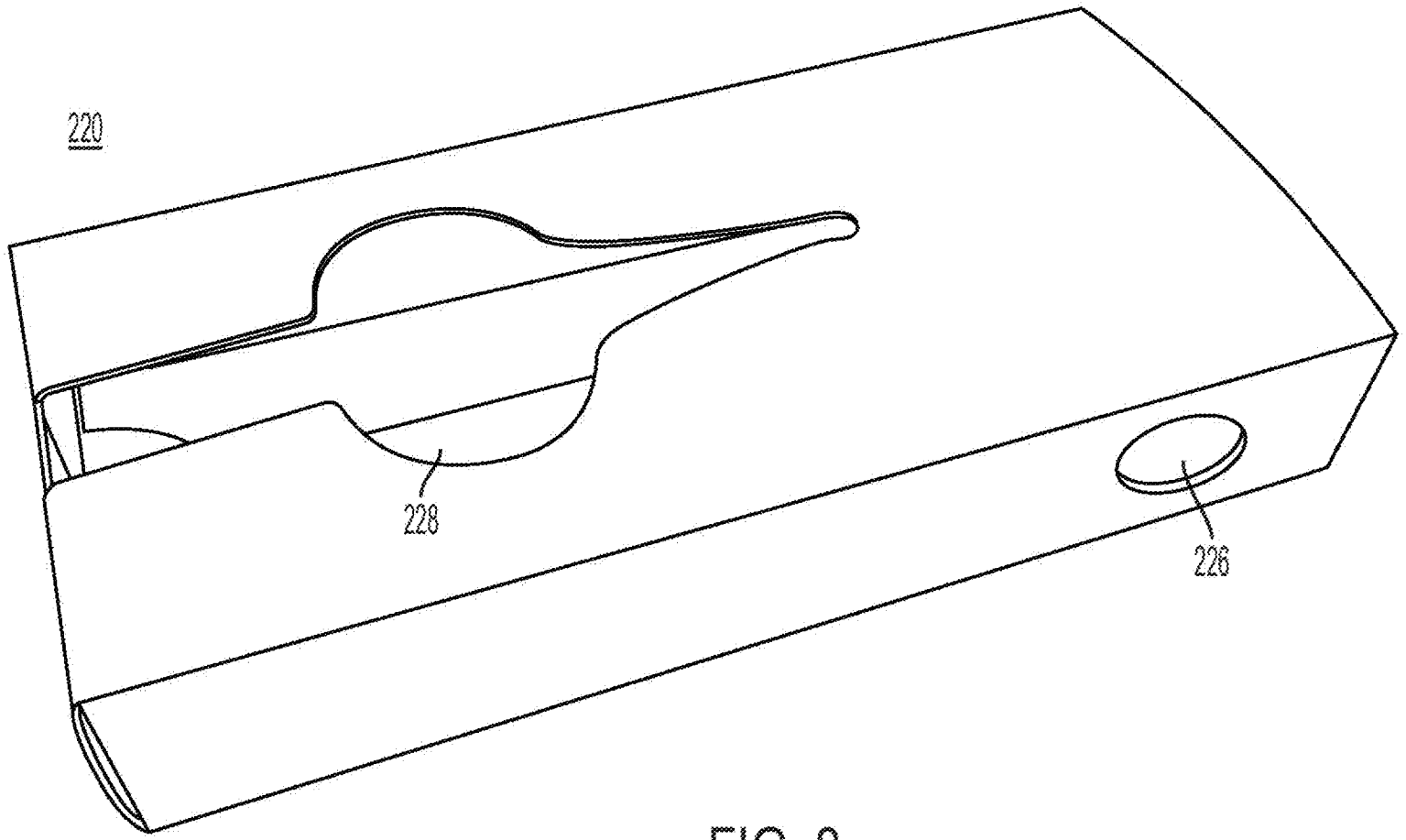
FIG. 8 is a perspective view of the second sleeve of the apparatus in accordance with the secondary embodiment disclosed in FIG. 7.
Figure 12:
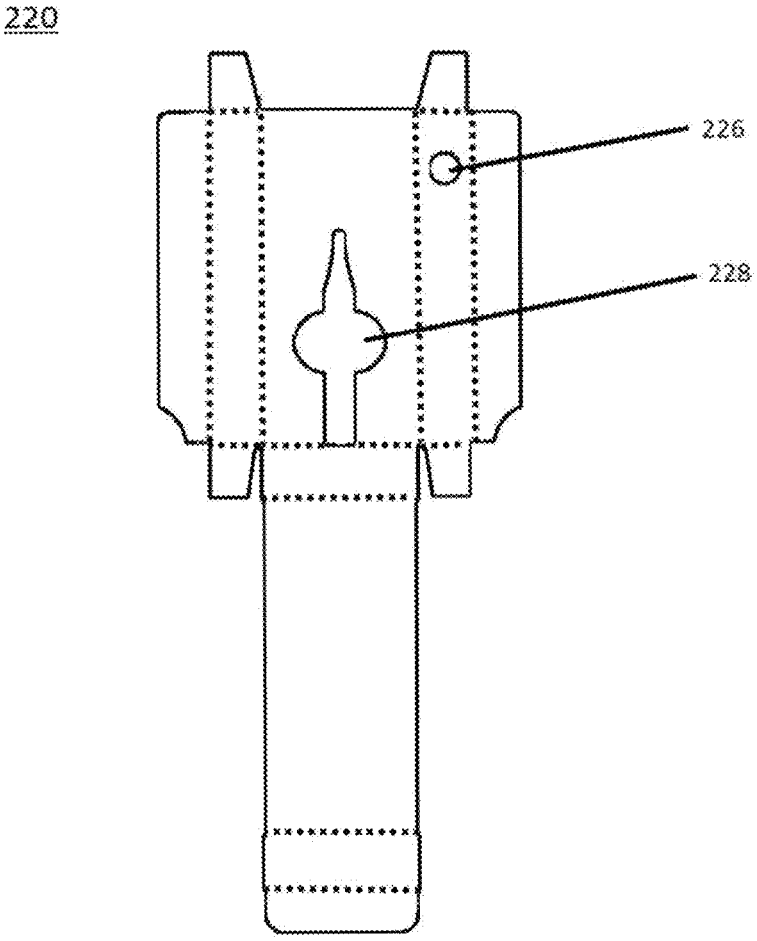
FIG. 12 is a top view of a paperboard sheet of the second sleeve in accordance with the secondary embodiment disclosed in FIG. 7.

As shown in FIG. 8, the second sleeve 220 may be a polyhedral container designed to reside within a pocket of the first sleeve 240. The second sleeve 220 may comprise one or more walls surrounding an open area. The open area of the second sleeve 220 is adapted to house the receptacle 250, the spring 260, and the button 280. The second sleeve 220 further comprises a hole 226 through one wall, whereby the button may extend outwardly from. The second sleeve 220 further comprises an opening 228 on one of its walls. The opening 228 of the second sleeve 220 is designed to allow a user to access and remove the object 290 secured within the receptacle 250. In one embodiment, the opening 228 is in a substantially similar shape as the shape of the object 290 to be secured within the receptacle 250. Further, as shown in FIG. 8, the opening 228 may be extended laterally beyond the shape of the object 290 to allow for additional clearance for a user to remove the object 290 from the receptacle 250. Although depicted as a semi-circle in FIG. 8, the lateral extension of the opening 228 may be any shape allowing for additional clearance to remove the object 290, such as rectangular or triangular. In one embodiment, as shown in FIG. 12, the second sleeve may be comprised of a single sheet of material, such as paper, that is cut, folded along the dotted lines, and glued, or assembled, to create its shape. In this embodiment, the opening 228 of the second sleeve 220 and the hole 226 are cut out of the material during manufacturing. The second sleeve 220 may further comprise a door as one wall that may be opened to allow access to the open area. In one embodiment, the door is simply one wall having a folded tab that is tucked into the open area.

Figure 9A:
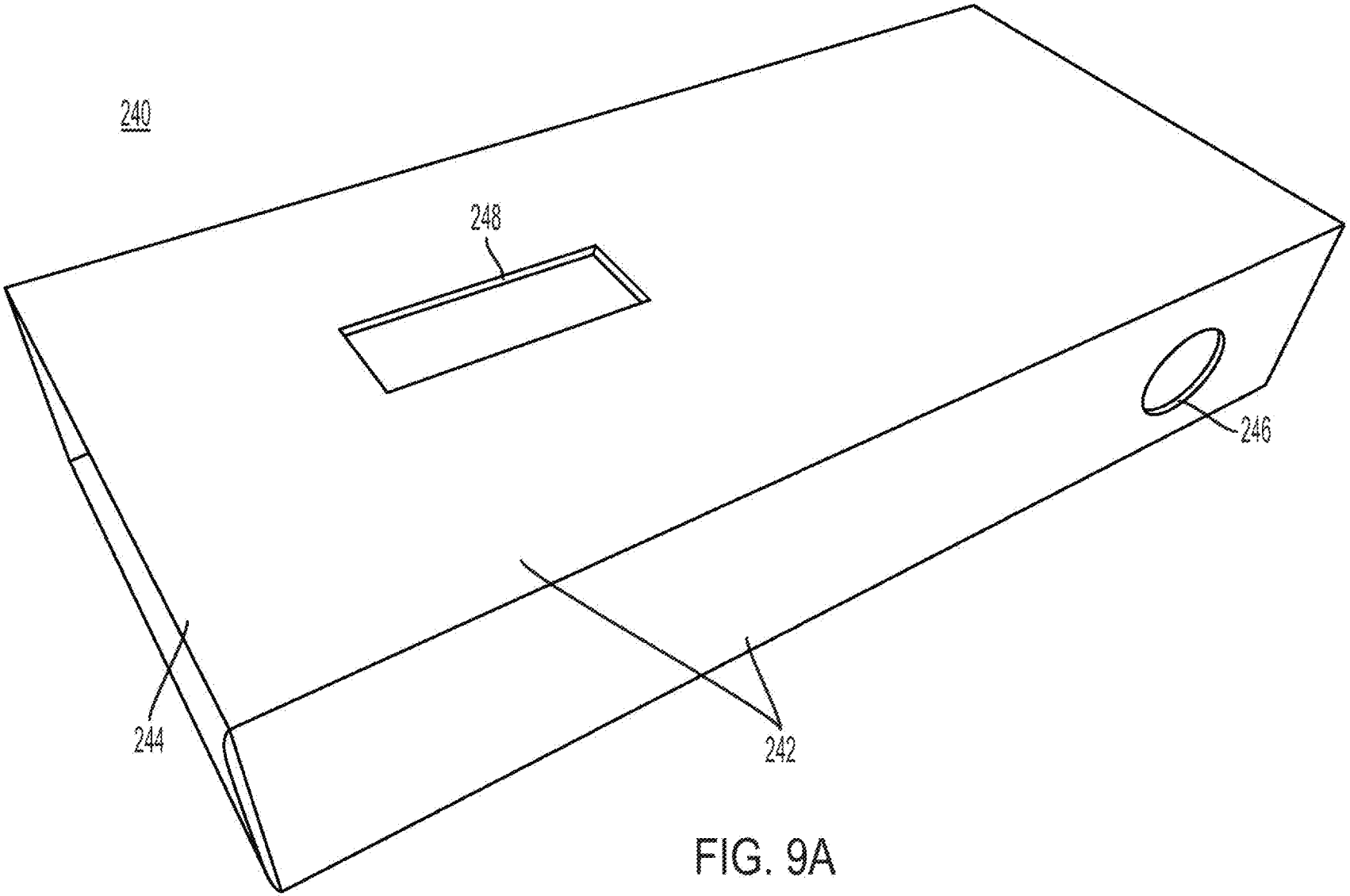
FIGS. 9A and 9B are top and bottom perspective views of the first sleeve of the apparatus in accordance with the secondary embodiment disclosed in FIG. 7.
Figure 9B:
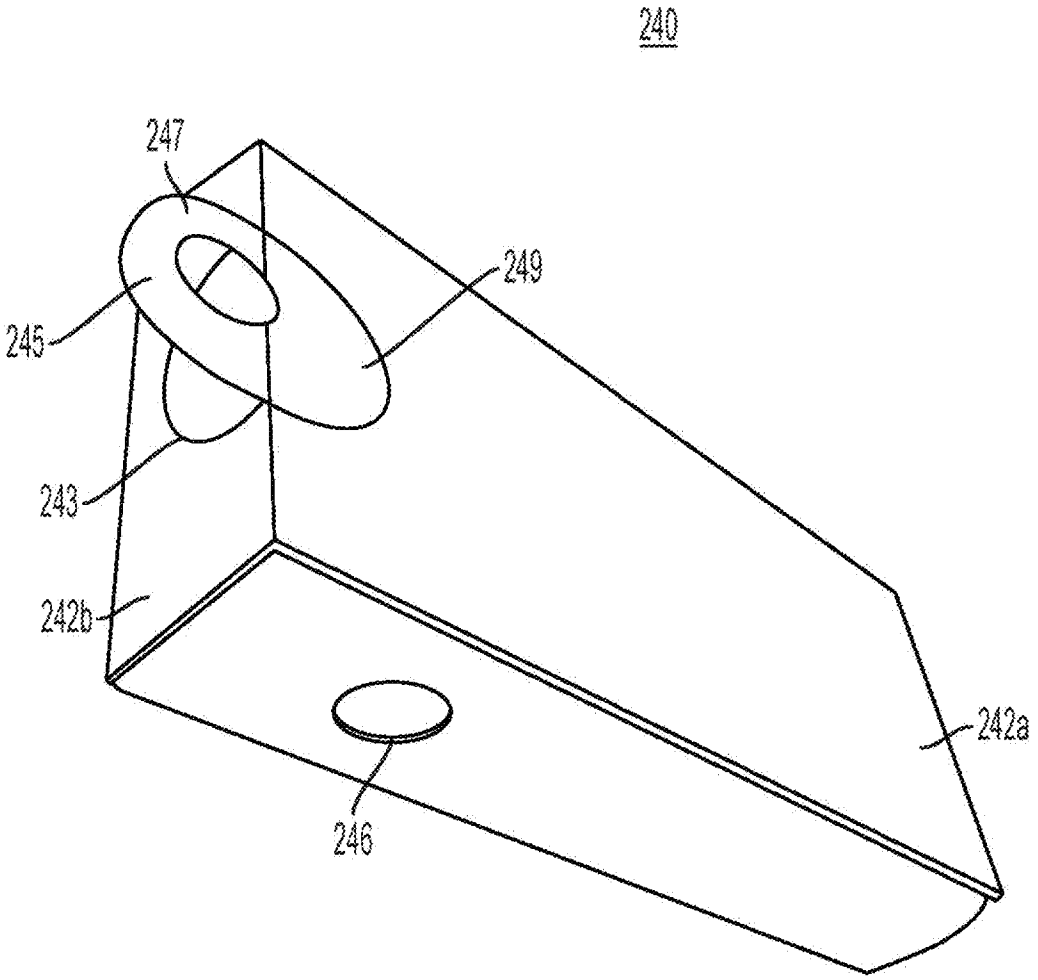
Figure 10:
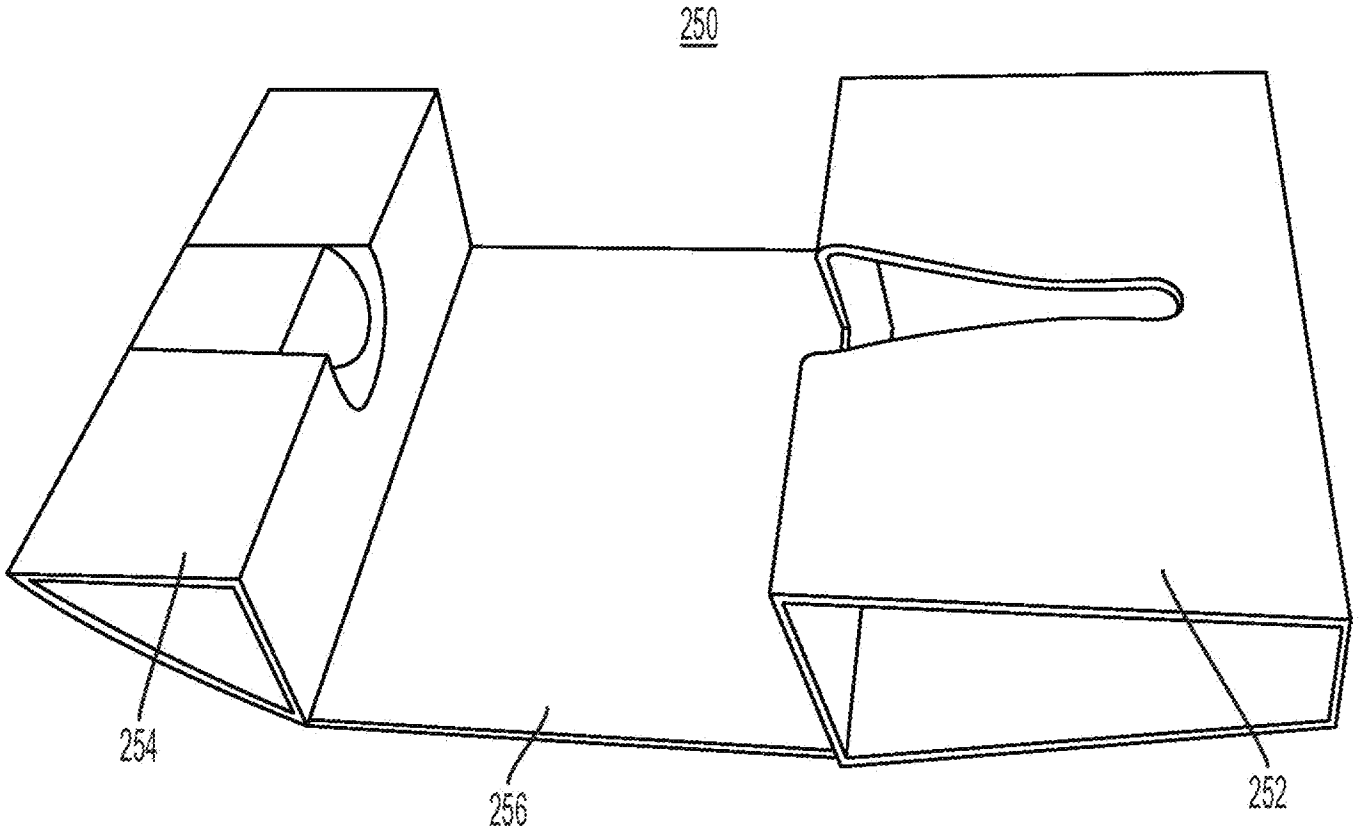
FIG. 10 is a perspective view of the receptacle in accordance with the secondary embodiment disclosed in FIG. 7.

As shown in FIGS. 9A and 9B, the first sleeve 240 is of similar construction as shown in the previously disclosed embodiments. The shape of the first sleeve 240 largely corresponds with that of the second sleeve 220, allowing for the second sleeve 220 to fit snuggly within the first sleeve 240. In the embodiment shown in FIG. 9A, the first sleeve 240 comprises five sidewalls 242 defining the pocket of the first sleeve 240. An entrance to the pocket is again defined by an entrance rim 244 and is located on a side of the first sleeve 240 corresponding to a smallest face of the container 200. The first sleeve 240 is further comprised of a hole 246 through at least one sidewall 242. The position of the hole 246 of the first sleeve 240 corresponds with the position of the hole 226 of the second sleeve 220, when the second sleeve 220 is housed within the first sleeve 240. Further, the size and shape of the hole 246 of the first sleeve 240 also corresponds to the size and shape of the hole 226 of the second sleeve 220. Thus, when the second sleeve 220 is fully housed within the first sleeve 240, the hole 226 of the second sleeve 220 and the hole 246 of the first sleeve 240 are substantially aligned so that an opening exists from the open area of the second sleeve 220 to outside the first sleeve 240.

The first sleeve 240 may also comprise a window 248 proximate the opening of the second sleeve 220. The window 248 allows a user to view the object 290 secured within the receptacle 250 without allowing the user to access the object 290. The window 248 may be a simple opening in a sidewall 242 of the first sleeve 240 or it may be covered by a transparent film, plastic, or glass. The window 248 may also be covered by a door, thereby not allowing light to hit the object 290 until the door is opened. The door may be one that flaps closed over the window or it may slide closed over the window 248.

The first sleeve 240 may further comprise an opening on one or more sidewalls 242, defined by an opening edge 243. The opening is adapted for assisting a user to either push or pull the second sleeve 220 out of the pocket of the first sleeve 240. In one embodiment, as demonstrated in FIG. 9B, the opening is at an edge between two sidewalls 242 on an end of the first sleeve 140 opposite the entrance to the pocket.

Figure 13:
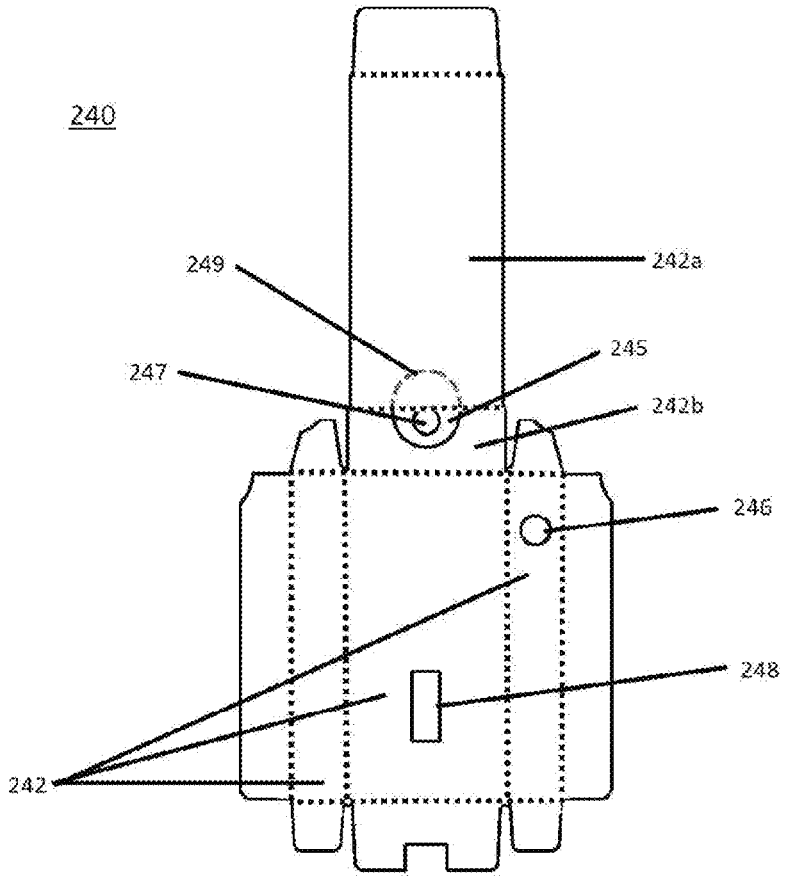
FIG. 13 is a top view of a paperboard sheet of the first sleeve in accordance with the secondary embodiment disclosed in FIG. 7.

As shown in FIG. 13, the first sleeve 240 may be comprised of a single sheet of material, such as paper, that is cut, folded along the dotted lines, and glued or assembled to create its shape. In this embodiment, the window 248 is cut from a sidewall 242. The opening may be cut along an edge of a back sidewall 242*a* and a top sidewall 242*b*. The opening may be a partial cut on the top sidewall 242*b*, whereby the material is still intact along the edge. An additional hole 247 may be punched out of the cut material. Once assembled, the cut material may lie in the same plane as the back sidewall 242*a* and extend above the top sidewall 242*b*. This allows for the cut material to be used as a hang tab 245, whereby the container may be hanged by threading the additional hole 247 through a peg of a retail display or the like. Although shown as a semi-circular cut, the opening and hang tab 245 may comprise any shape that allows for access to the second sleeve 220 and that may be used as a hang tab. The first sleeve may further comprise a perforated cut 249 along on the back sidewall 242*a* or the edge proximate to the opening, whereby the hang tab 245 may be removed by tearing the paper along the perforated cut 249. The removal of the hang tab 245 along the perforated cut 249 may also expand the opening, allowing for easier access to push or pull the second sleeve 220.

Figure 7:
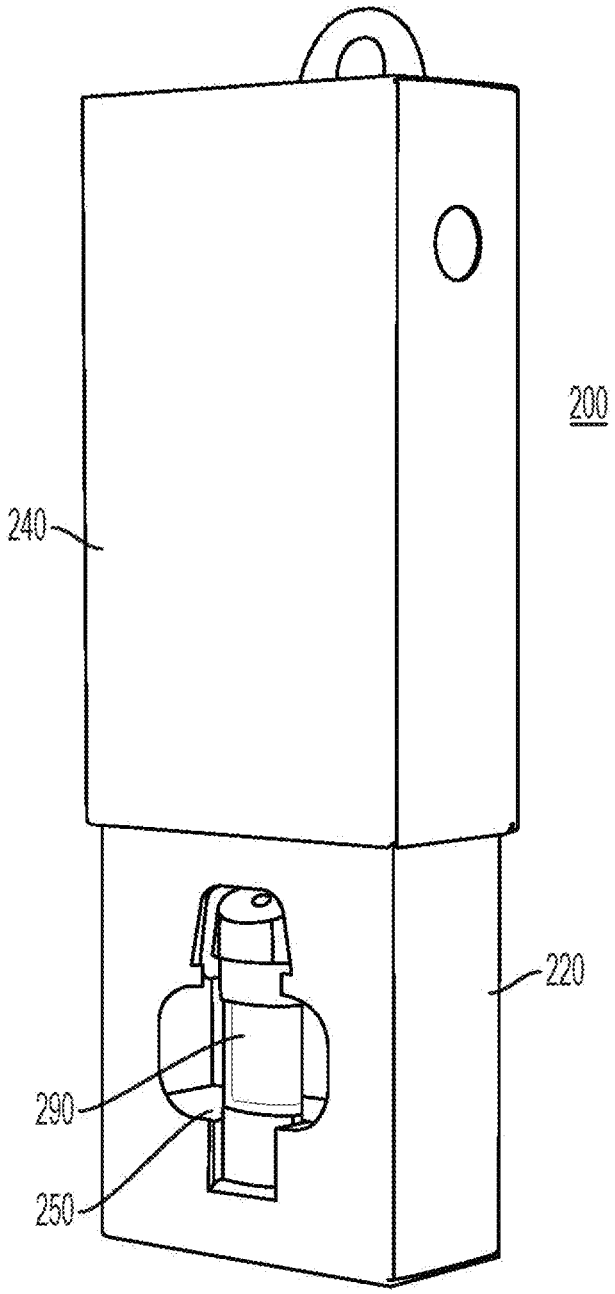
FIG. 7 is a perspective view of a secondary embodiment of the apparatus in a partially opened position.

The receptacle 250 is housed within the second sleeve 220 and is adapted to receive and secure an object 290. In one embodiment, the receptacle 250 has a width and depth that is substantially equal to the width and depth of the second sleeve 240. As shown in FIG. 7, the receptacle 250 resides in a lower portion of the second sleeve 220. However, it is within the scope of the disclosure that the receptacle may reside in an upper portion of the second sleeve 220. The receptacle 250 may comprise any material necessary to secure an object 290, such as plastic, rubber, paper, foam, metal, or any combination thereof. In one embodiment, the receptacle 250 secures the object 290 via an interference fit. The receptacle 250 may comprise an upper portion 252, a middle portion 256 and a lower portion 254. The upper portion 252 and the lower portion 254 may comprise recessed or cut-out material of the receptacle 250 in the general shape of the object 290, whereby the object 290 may be pressed into the recess or cut-out material of the receptacle 250 and secured in place. The middle portion 256 of the receptacle 250, situated between the upper portion 252 and lower portion 254, may completely recessed. This allows for access to the sides of the object 290 when it is secured in the receptacle 250, which aids in the object's 290 removal.

Figure 14:
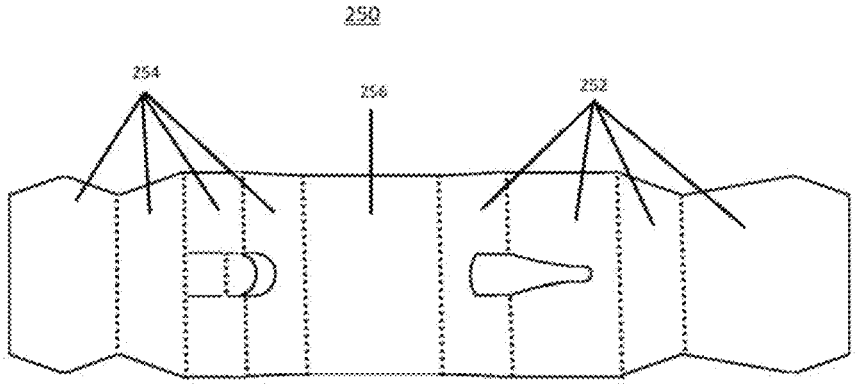
FIG. 14 is a top view of a paperboard sheet of the receptacle in accordance with the secondary embodiment disclosed in FIG. 7.
Figure 15:
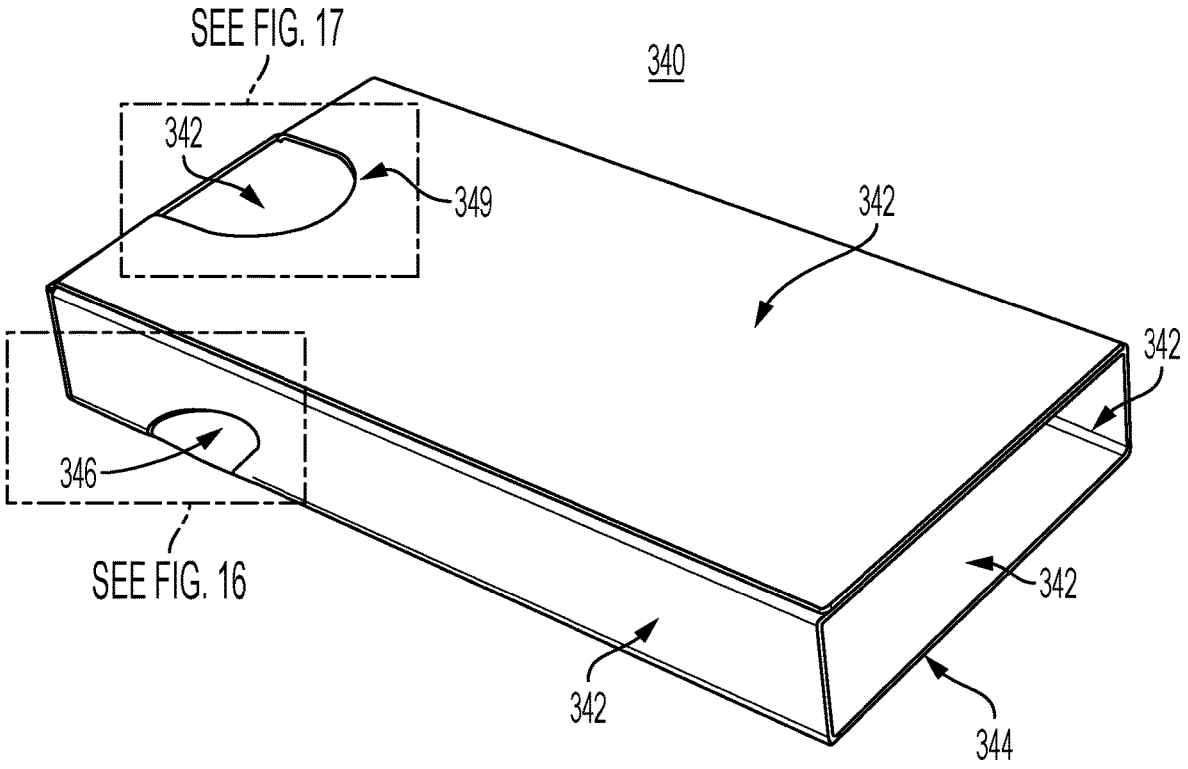
FIG. 15 is a perspective view of a sleeve in accordance with the third embodiment of the present invention.

As shown in FIG. 14, the receptacle 250 may be comprised of a single folded sheet of paper. The single sheet may be folded and glued or assembled to form the three-dimensional shape of the receptacle. As shown in FIG. 14, the paper sheet is folded along the dotted lines whereby the upper portion 252 and lower portion 254 are substantially on the same plane, the middle portion 256 is recessed below the upper portion 252 and the lower portion 254, and a back side of the tips of the sheet 258 are glued to a backside of the middle portion 256.

The receptacle 250, the spring 260, and the button 280 are designed to reside within the open area of the second sleeve 220. In one embodiment, the receptacle 250 resides in a lower portion of the second sleeve 220, and the spring 260 and button 280 reside in an upper portion of the second sleeve 220. Further, in this embodiment, the receptacle 250, the spring 260, and the button 280 comprise substantially all the volume of the open area of the second sleeve 220, thereby allowing for only nominal movement of the components within the open area.

As described above in connection with the other embodiments, the button 280 is position proximate the hole 226 of the second sleeve 220 and extend distally through the hole 226. A portion of the button 280, such as a button base 282, may lie flat on an inner face of the wall of the second sleeve 220, thereby hindering the button 280 from exiting the hole 226 of the second sleeve 220. The spring 260 may be comprised of a resilient material, allowing it to be compressed during the depression of the button 280. Once the force on the button 280 is released, the spring 260 pushes the button 280 back to its original position. In the closed position, the button 280 is designed to extend through both the hole 226 of the second sleeve and the hole 246 of the first sleeve 240.

Figure 11A:
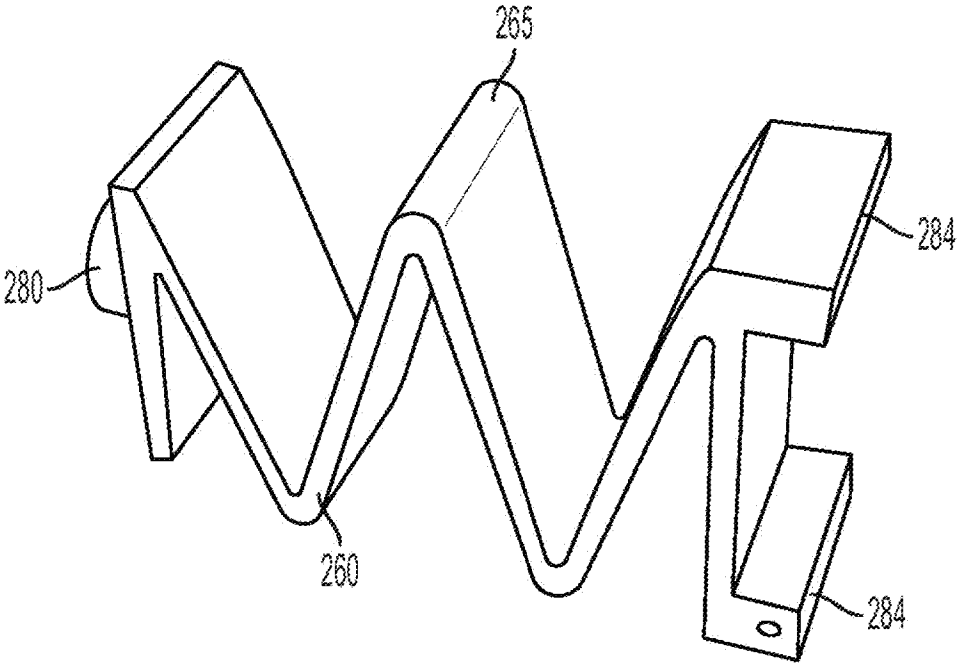
FIG. 11A is a perspective view of the button and the spring in accordance with the secondary embodiment disclosed in FIG. 7.
Figure 11B:
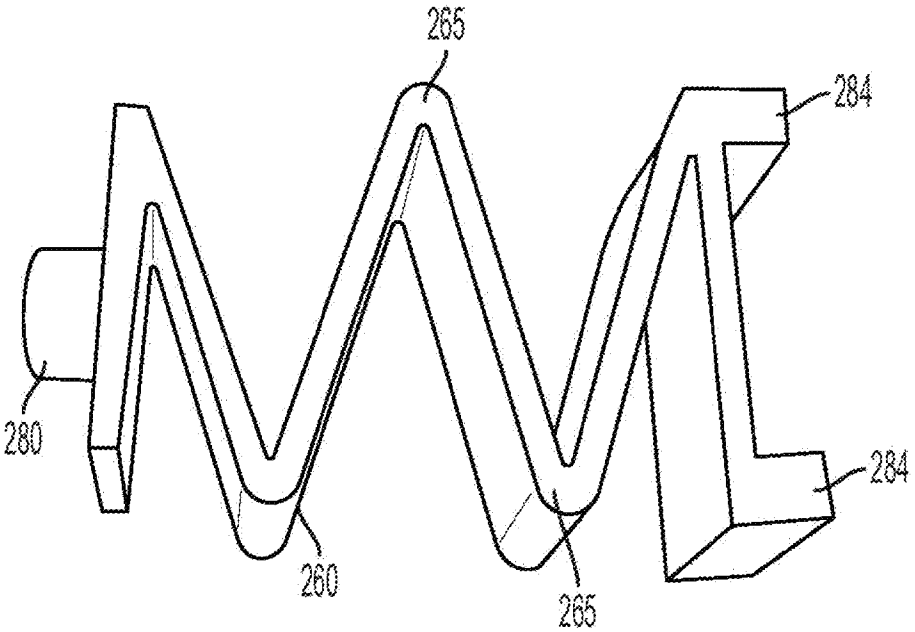
FIG. 11B is a side view of the button and the spring in accordance with the secondary embodiment disclosed in FIG. 7.

In one embodiment, as shown in FIGS. 11A and 11B, the button 280 and the spring 260 are an integral component. In this embodiment, the spring 260 and the button 280 are manufactured as a single piece of a resilient material such as plastic, metal, or a composite. The spring 260 is in a generally zig-zag shape, allowing for slight plastic deformation at one or more peaks and troughs 265 of the spring. Alternatively, the spring 260 could have a spiral shape, "C" shape, "V" shape, leaf shape, or any other shape that would provide a spring-like property upon compressive deformation. This plastic deformation allows the spring 260 to be compressed and the button 280 to be pushed inward. As shown in FIG. 11B, combined spring 260 and button 280 may also comprise two or more feet 284 at an end opposite the button 280. The two or more feet 284 allow for easier installation of the combined spring 260 and button 280 and creates support for the spring 260.

In yet another embodiment, disclosed in FIGS. 15-22, the lockable container 300 comprises a sleeve 340 and a hinged shell 320. The hinged shell 320 is adapted to be housed within a pocket of sleeve 340 when the hinged shell 320 is in its closed position. The outside dimensions of the hinged shell 320 in the closed position, such as its height, width, and length, are no greater than the inside dimensions of sleeve 340, permitting the hinged shell 320 to be completely housed within sleeve 340.

As shown in FIGS. 15-18, sleeve 340 comprises an entrance, defined by rim 344 through which hinged shell 320 enters sleeve 340. Sleeve 340 comprises of one or more sidewalls 342. In one embodiment, sleeve 340 comprises five sidewalls 342 defining the pocket of sleeve 340. Sleeve 340 further comprises a slit 346 through at least one sidewall 342. The position of the slit 346 of sleeve 340 corresponds with the position of a lock tab 326 on hinged shell 320 (See FIGS. 18-21), so that the lock tab 326 and slit 346 are aligned when hinged shell 320 is fully inserted in sleeve 340.

Figure 16:
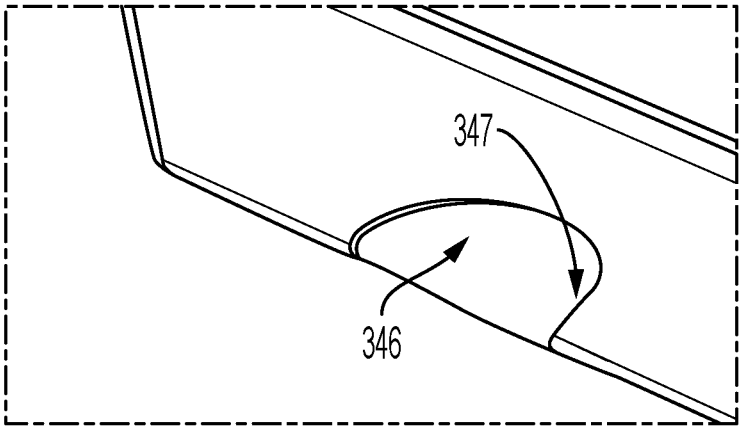
FIG. 16 is a detailed view of a sleeve slit in accordance with the third embodiment of the present invention.
Figure 17:
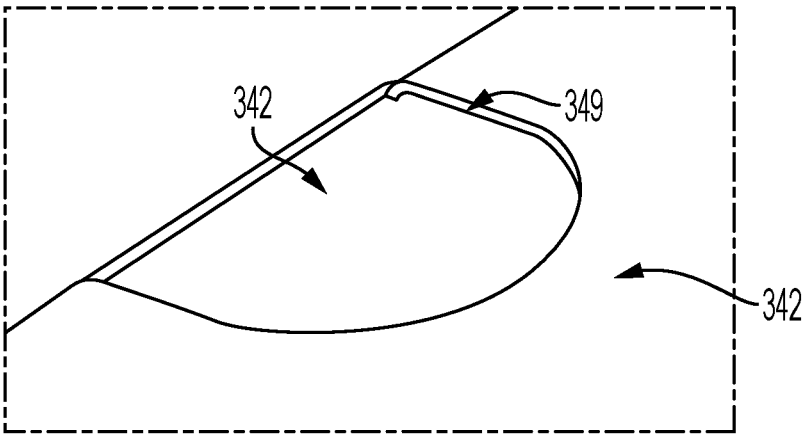
FIG. 17 is a detailed view of a sleeve finger hole in accordance with the third embodiment of the present invention.

As shown in FIG. 16, slit 346 of sleeve 340 has an edge 347 on the side of slit 346 that is closest to entrance rim 344. Slit edge 347 is adapted to impinge on a rear edge 348 (see FIG. 21) of lock tab 326 to prevent hinged shell 320 from sliding out of sleeve 340 unless the lock tab 326 is flexed upwards at the same time hinged shell 320 is pushed out. Sleeve 340 further comprises a finger hole 349 which provides partial access to the hinged shell 320 when it is disposed inside sleeve and enables a user to push hinged shell 320 out of sleeve 340.

Figure 18:
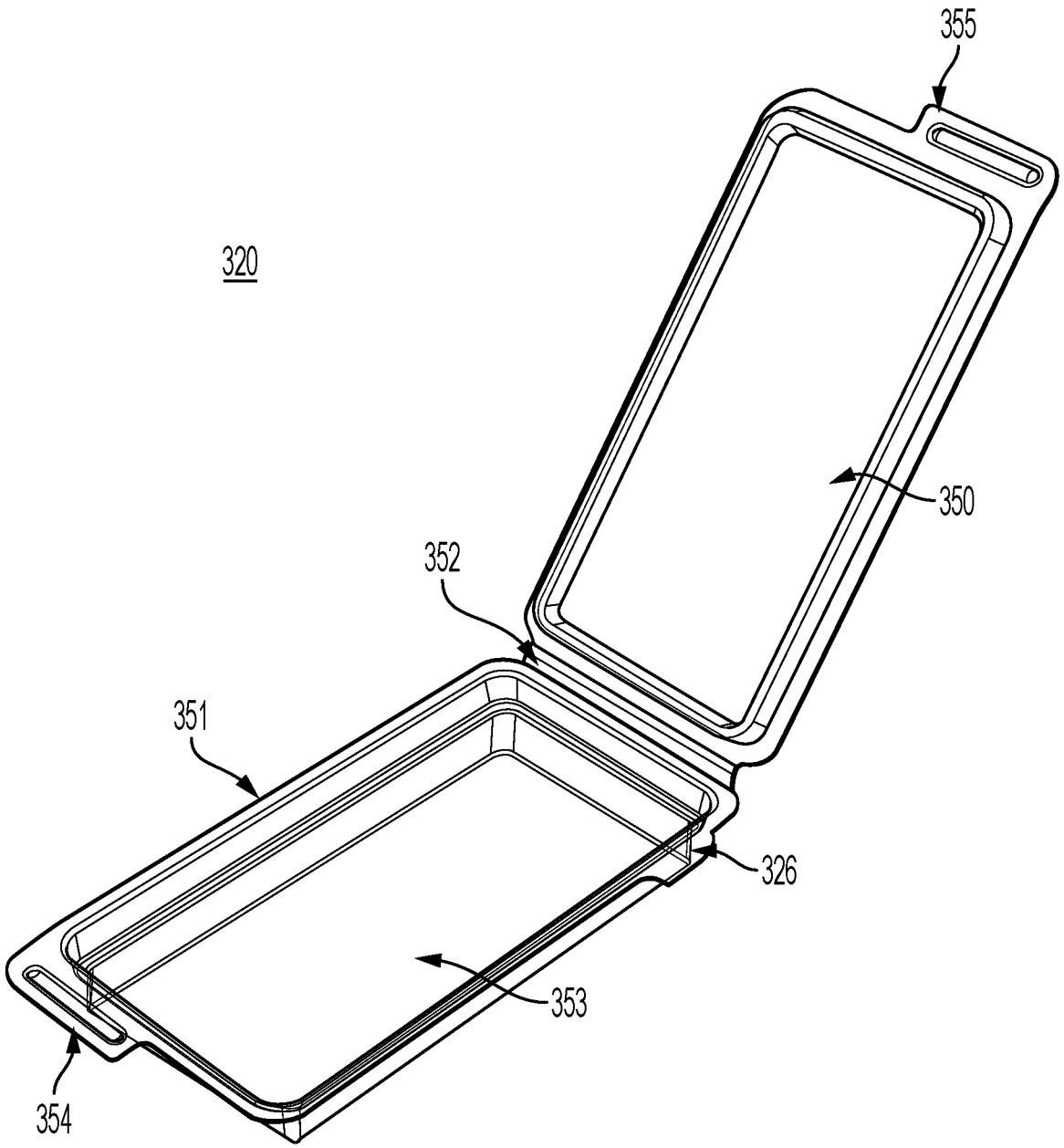
FIG. 18 is a perspective view of a hinged shell in the open position in accordance with the third embodiment of the present invention.
Figure 19:
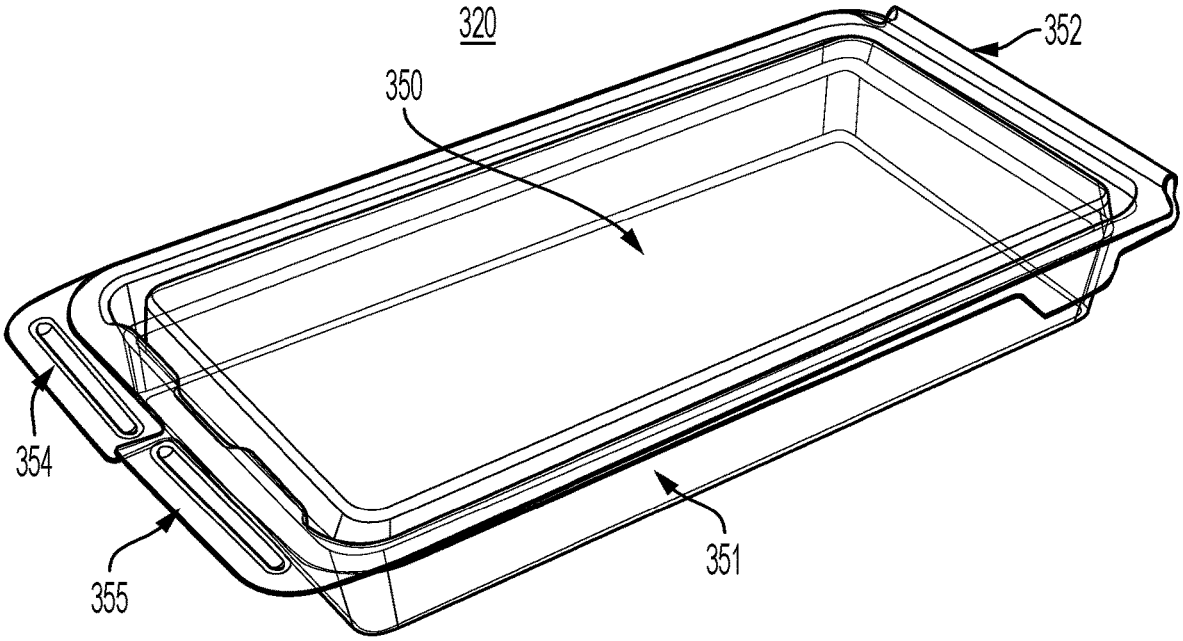
FIG. 19 is a perspective view of a hinged shell in the closed position in accordance with the third embodiment of the present invention.
Figure 20:
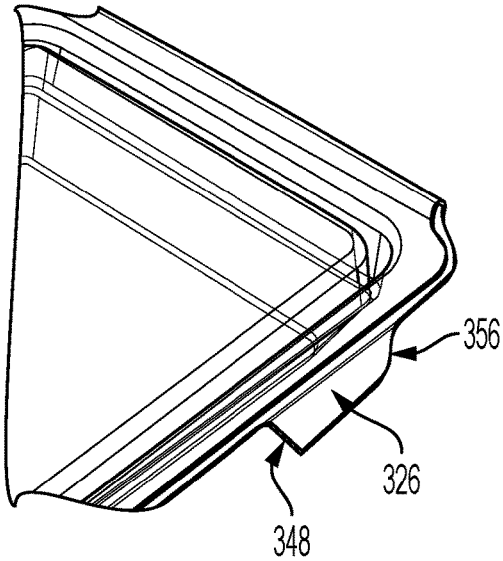
FIG. 20 is a detailed view of a hinged shell locking tab in accordance with the third embodiment of the present invention.

As shown in FIGS. 18-20, hinged shell 320 is of unitary construction and made from a resilient and durable, yet flexible, material such as, for example and not by way of limitation, polyethylene terephthalate ("PETE"). Hinged shell 320 comprises a lid 350, and tray 351, which are hingeably joined at one edge by hinge 352. Tray 351 comprises storage space 353 of suitable size to hold any object or substance that is stored within lockable container 300. Hinge 352 can comprise an integral strip of material adapted to flex in two directions, as shown in the attached figures, or can be of one of many different designs for linear hinges known in the art, such as a channel formed at the juncture of the lid 350 And tray 351. In the disclosed embodiment hinge 352 joins the rearmost edges of lid 350 and tray 351. However, alternative designs are easily envisioned within the spirit of the present invention where the left or right edges of hinged shell 320 comprise a hinge.

Lid 350 and tray 351 Are adapted to cooperatively engage and releasably remain in a closed position until opened. This can, for example, be achieved by creating an interference fit between the edges of lid 350 and tray 351. Alternatively other cooperating features, such as a slot and tab arrangement (not shown) can be incorporated into the design. Lid 350 and tray 351 may also incorporate offset opening tabs (354, 355) to facilitate opening and closing. As indicated above, lock tab 326 is incorporated into one edge of hinged shell 320 so that upon insertion of hinged shell 320 into sleeve 340, lock tab 326 is aligned with slit 346. Lock tab has a front edge 356 and a rear edge 348. Rear edge is substantially perpendicular to the edge of hinged shell 320 in order to maximize contact with slit edge 347 when the sleeve 320 and hinged shell 340 are engaged. Front edge 356 is optionally curved to facilitate the insertion of hinged shell 320 into sleeve 340.

In operation, the substance or product to be protected is placed inside storage space 353 of hinged shell 320. Lid 350 and tray 351 are then drawn together until they engage and close hinged shell 320. Hinged shell 320 is then inserted through its rear end into rim 344 of sleeve 340. Locking tab 326 may be flexed up or down to facilitate insertion into sleeve 340. As the rear edge of hinged shell 320 approaches the rear of sleeve 340, locking tab 326 emerges through slit 346. The rear edge 348 of locking tab 326 engages slit edge 347 and prevents hinged shell 320 from sliding out of sleeve 340. In order to remove hinged shell 320 from sleeve 340, locking tab 326 must be flexed up, disengaging rear edge 348 from slit edge 347, and simultaneously, sleeve 320 can be slid out by pushing it through finger hole 349.

Figure 21:
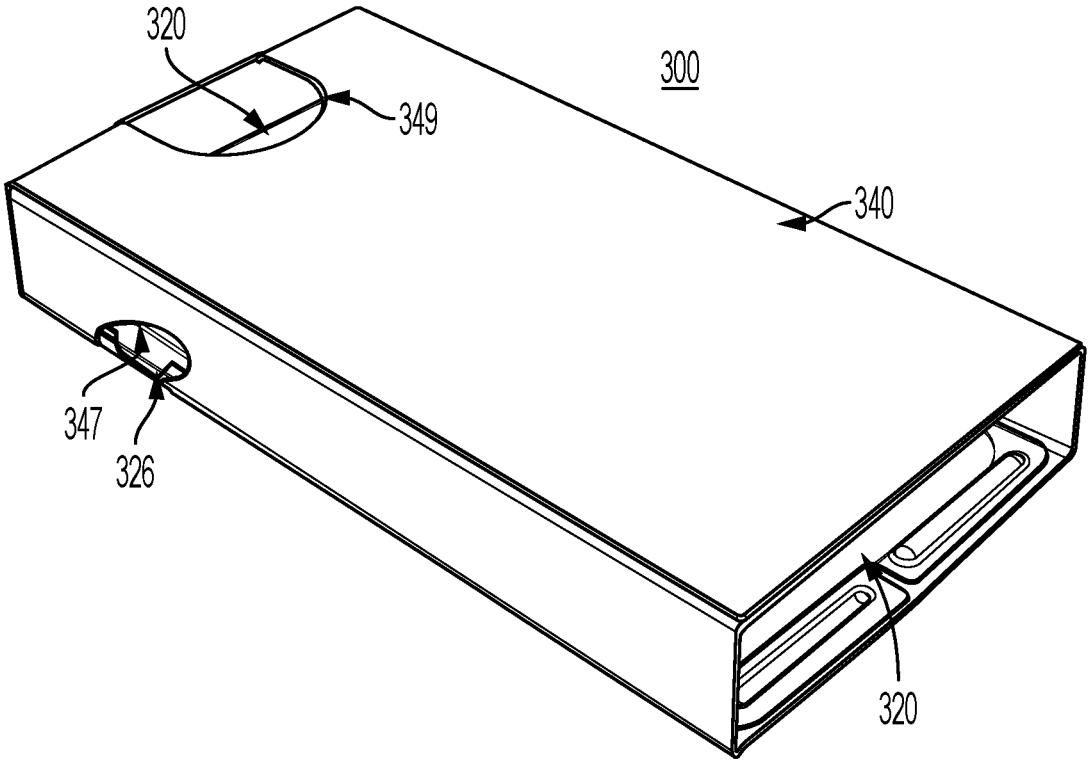
FIG. 21 is a perspective view of a hinged shell and sleeve in the locked configuration in accordance with the third embodiment of the present invention.
Figure 22:
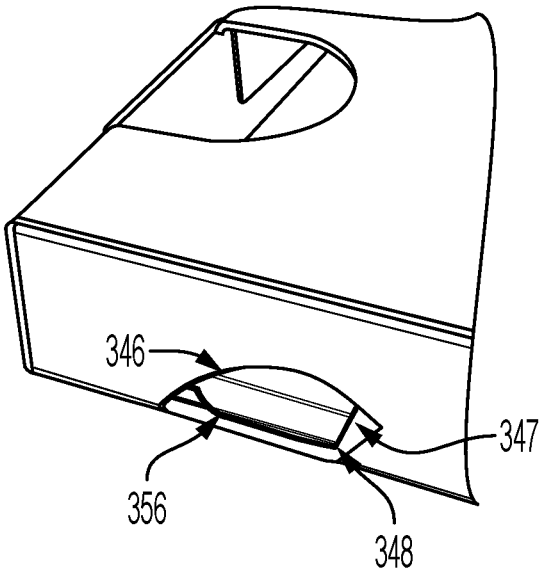
FIG. 22 is a detailed view of a hinged shell locking tab and a sleeve slit in the locked configuration in accordance with the third embodiment of the present invention.

FIGS. 21 and 22 illustrate the sleeve 340 and hinged shell 320 while engaged in a locked configuration.

In yet another embodiment, disclosed in FIGS. 23-28, the lockable container 400 comprises a sleeve 440 and a resilient tray 420 with a cantilevered button 4??. The resilient tray 420 is adapted to be housed within a pocket of sleeve 340. The outside dimensions of the resilient tray 420, such as its height, width, and length, are no greater than the inside dimensions of sleeve 440, permitting the resilient tray 420 to be completely housed within sleeve 440.

Figure 23:
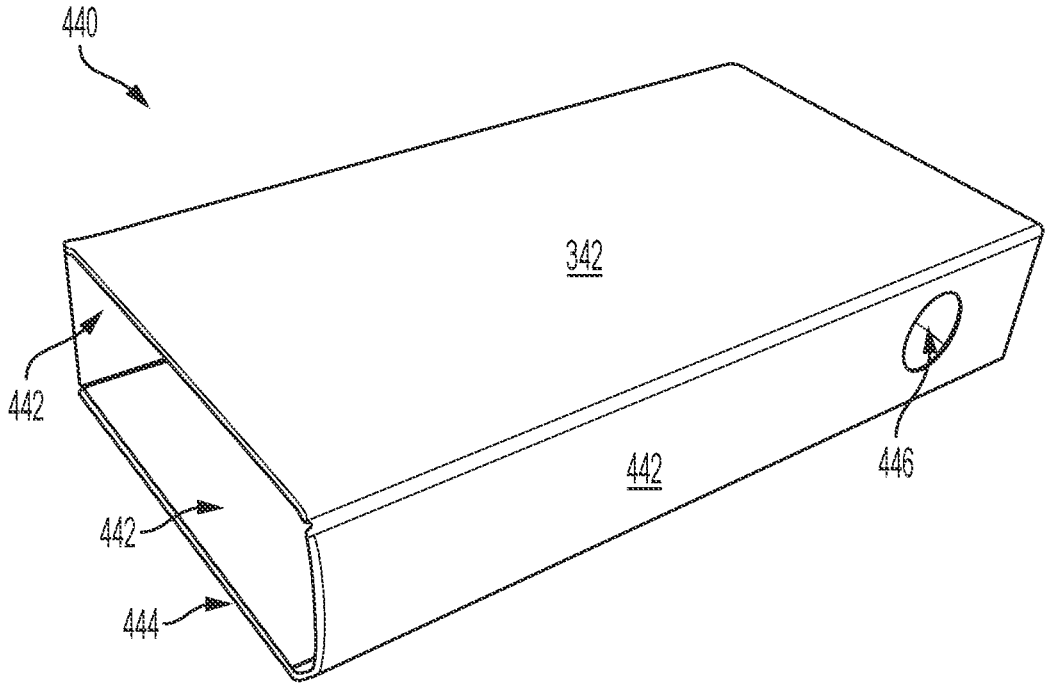
FIG. 23 is a front perspective view of a sleeve in accordance with the fourth embodiment of the present invention.
Figure 24:
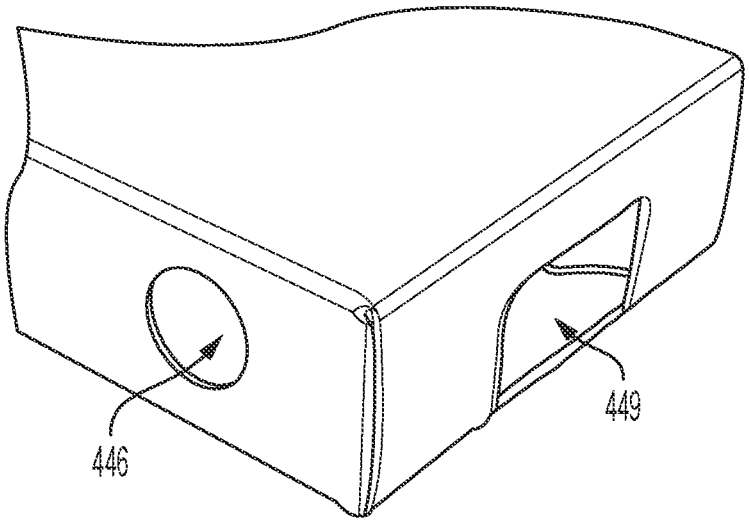
FIG. 24 is a rear perspective detailed view of a sleeve in accordance with the fourth embodiment of the present invention.
Figure 25:
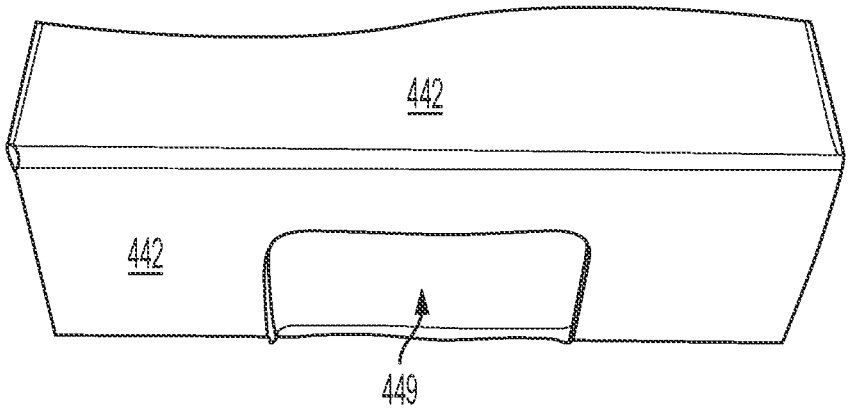
FIG. 25 is a rear view of a sleeve finger hole in accordance with the fourth embodiment of the present invention.

As shown in FIGS. 23-25, sleeve 440 comprises an entrance, defined by rim 444 through which resilient tray 420 enters sleeve 440. Sleeve 440 comprises of one or more sidewalls 442. In one embodiment, sleeve 440 comprises five sidewalls 442 defining the pocket of sleeve 440. Sleeve 440 further comprises a hole 446 through at least one sidewall 442. The position of the hole 446 sleeve 440 corresponds with the position of a button 426 (See FIG. 26) on resilient tray 420, when resilient tray 420 is housed within sleeve 440. Further, the size and shape of the hole 446 of sleeve 440 also corresponds to the size and shape of button 426 of resilient tray 420. Thus, when resilient tray 420 is fully housed within sleeve 440, Button 426 of resilient tray 420 and hole 446 of sleeve 440 are substantially aligned so that button 426 protrudes through hole 446 of sleeve 440. It should be noted that in some embodiments the size of hole 446 may be slightly larger than button 426.

Figure 29:
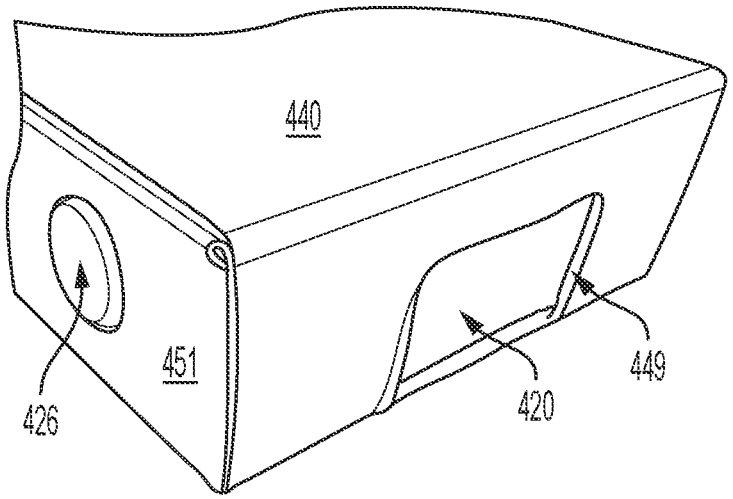
FIG. 29 is a rear perspective view of a resilient tray and sleeve in the locked configuration in accordance with the fourth embodiment of the present invention.

As shown in FIG. 29, Button 426 is adapted to protrude through hole 446 when resilient tray 420 is fully inserted in sleeve 440 so that resilient tray 420 is prevented from sliding out of sleeve 440 unless button 426 is depressed sufficiently to clear sidewall 442 on resilient tray 420 at the same time that resilient tray 420 is pushed out of sleeve 440. Referring back to FIGS. 24-25, sleeve 440 further comprises a finger hole 449 which provides partial access to the resilient tray 420 when it is disposed inside sleeve and enables a user to push resilient tray 420 out of sleeve 440.

Figure 26:
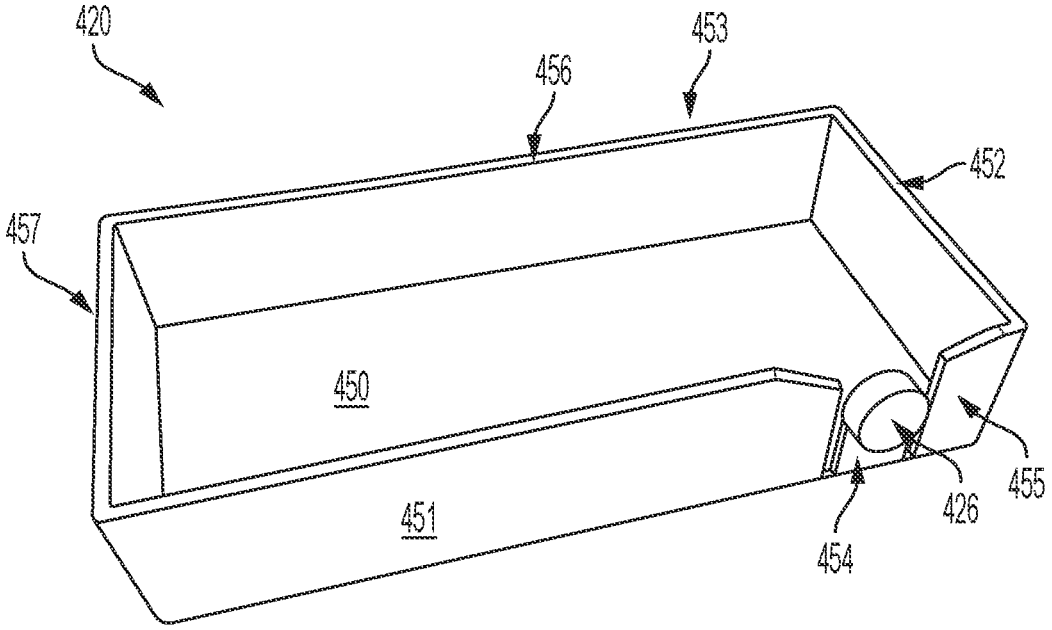
FIG. 26 is a perspective view of a resilient tray in accordance with the fourth embodiment of the present invention.
Figure 27:
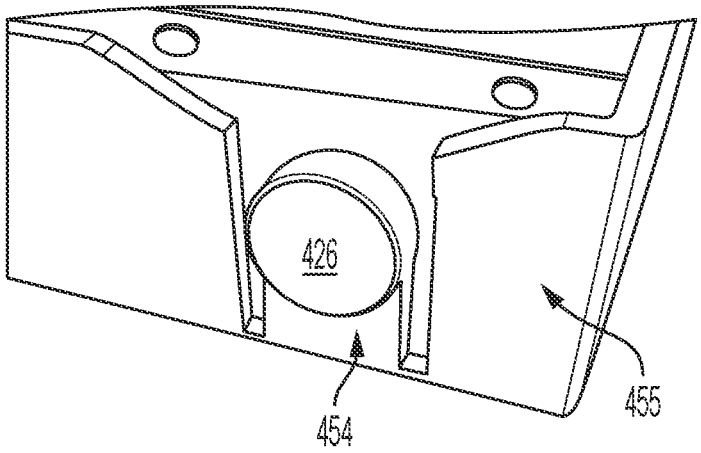
FIG. 27 is a detailed view of a resilient tray cantilevered tab and button in accordance with the fourth embodiment of the present invention.

As shown in FIGS. 26 and 27, resilient tray 420 is of unitary construction and made from a resilient and durable, yet flexible, material such as, for example and not by way of limitation, molded plastic. Resilient tray 420 comprises a floor 450, three sidewalls 452, 456, 457, and one partial sidewall 451. On the same edge as the partial sidewall 451, a cantilever tab 454 extends from floor 450 and terminates in button 426. Cantilever tab 454, which is flexible, enables button 426 to move in a direction substantially perpendicular to partial sidewall 451 when depressed, and to return to its original position when pressure is removed. A continuation wall 455 may optionally be included on the other side of cantilever tab 4454 and button 426, extending to sidewall 452. Resilient tray 420 comprises an interior storage space 453 of suitable size to hold any object or substance that is stored within lockable container 400.

In operation, the substance or product to be protected is placed inside storage space 453 of resilient tray 420. Button 426 is then depressed so that when resilient tray 420 is inserted through its rear end into rim 444 of sleeve 440, button 426 is flush wit, or slightly inside of, sidewall 451. As the rear edge of resilient tray 420 approaches the rear of sleeve 440, button 426 emerges hole 446. Button 426 engages hole 446 and prevents resilient tray 420 from sliding out of sleeve 440. In order to remove resilient tray 420 from sleeve 440, button 426 must be pressed in, disengaging button 426 from hole 446, while simultaneously urging resilient tray 420 out of sleeve 440 by pushing it through finger hole 449.

Figure 28:
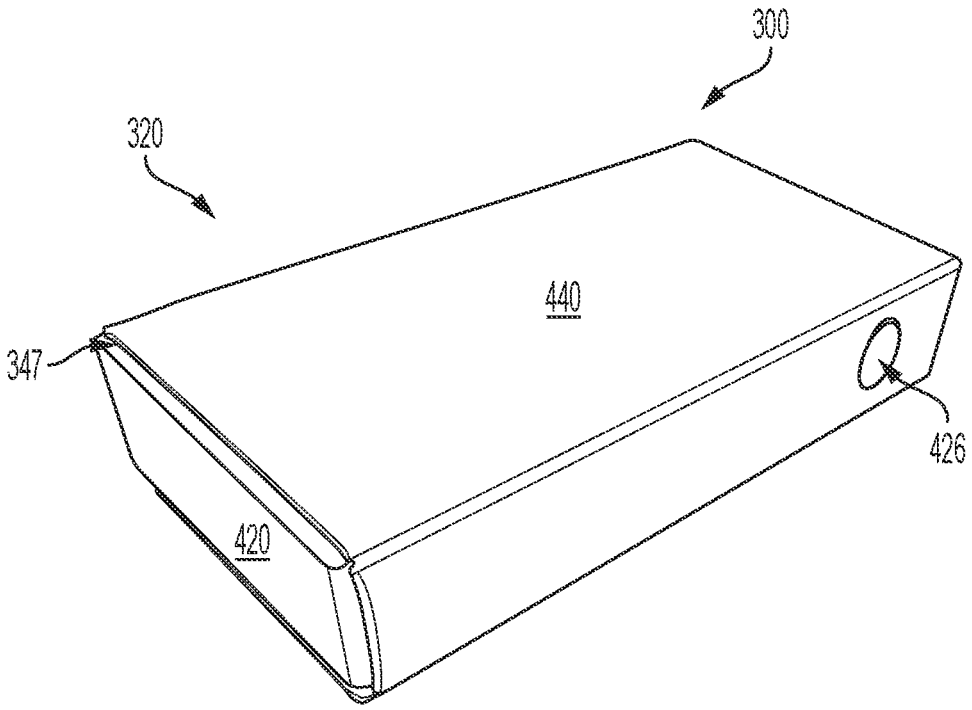
FIG. 28 is a front perspective view of a resilient tray and sleeve in the locked configuration in accordance with the fourth embodiment of the present invention.

FIGS. 28 and 29 illustrate the sleeve 440 and hinged shell 420 while engaged in a locked configuration.

Any reference in this specification to "one embodiment," "an embodiment," an "example embodiment," etc., means that a particular feature, structure, or characteristic described in connection with the implementation is included in at least one embodiment of the invention. The appearances of such phrases in various places in the specification are not necessarily referring to the same embodiment. In addition, any elements or limitations of any invention or embodiment thereof disclosed herein can be combined with any and/or all other elements or limitations (individually or in any combination) or any invention or embodiment thereof disclosed herein, and all such combinations are contemplated with the scope of the invention without limitation thereto.

It should be understood that the examples and embodiments described herein are for illustrative purposes only and that various modifications or changes in light thereof will be suggested to persons skilled in the art and are to be included within the spirit and purview of this application.

The invention claimed is:

1. A lockable container comprising:

a sleeve having at least three sidewalls defining a pocket, the pocket having at least one entrance, and the pocket adapted for receiving and housing a resilient tray, a least one sidewall of the sleeve having a hole;

a resilient tray having three sidewalls, a partial sidewall, a floor and a button, the button located contiguous to the partial sidewall, and hinged to the floor by a cantilevered tab, the resilient tray comprised of a flexible, semi-rigid material;

wherein the button is substantially aligned with the hole when the resilient tray is housed within the sleeve, causing the button to protrude through the hole; and wherein the resilient tray is prevented from sliding out of the sleeve unless the button is pressed to disengage the hole.

* * * * *